US007363958B2

(12) United States Patent
Fehlemann et al.

(10) Patent No.: US 7,363,958 B2
(45) Date of Patent: Apr. 29, 2008

(54) CONTINUOUS CASTING MOLD FOR LIQUID METALS, ESPECIALLY FOR LIQUID STEEL

(75) Inventors: Gereon Fehlemann, Düsseldorf (DE); Hans Streubel, Erkrath (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/525,289

(22) PCT Filed: Mar. 25, 2003

(86) PCT No.: PCT/EP03/03081

§ 371 (c)(1),
(2), (4) Date: Oct. 17, 2005

(87) PCT Pub. No.: WO03/106073

PCT Pub. Date: Dec. 24, 2003

(65) Prior Publication Data

US 2006/0102313 A1 May 18, 2006

(30) Foreign Application Priority Data

Jun. 13, 2002 (DE) ..... 102 26 214

(51) Int. Cl.
*B22D 11/00* (2006.01)

(52) U.S. Cl. ..... 164/418; 164/443; 164/348

(58) Field of Classification Search ..... 164/418, 164/443, 459, 485, 348
See application file for complete search history.

(56) References Cited

U.S. PATENT DOCUMENTS

| | | | | |
|---|---|---|---|---|
| 3,125,786 | A * | 3/1964 | Savage | 164/435 |
| 3,978,910 | A * | 9/1976 | Gladwin | 164/443 |
| 4,658,884 | A | 4/1987 | Euler et al. | |
| 5,467,810 | A * | 11/1995 | Grove | 164/418 |
| 5,526,869 | A | 6/1996 | Sears, Jr. | |
| 5,927,378 | A | 7/1999 | Grove et al. | |
| 6,145,579 | A | 11/2000 | Stagge et al. | |
| 6,443,221 | B1 * | 9/2002 | Suzuki et al. | 164/502 |
| 6,926,067 | B1 * | 8/2005 | Horneschemeyer et al. | 164/418 |
| 2002/0129922 | A1 * | 9/2002 | Plociennik et al. | 164/443 |

FOREIGN PATENT DOCUMENTS

| | | | | |
|---|---|---|---|---|
| EP | 1 025 930 | | 8/2000 | |
| EP | 1 206 986 | | 5/2002 | |
| JP | 03118943 | * | 5/1991 | 164/443 |

* cited by examiner

*Primary Examiner*—Jonathan Johnson
*Assistant Examiner*—I.-H. Lin
(74) *Attorney, Agent, or Firm*—Friedrich Kueffner

(57) ABSTRACT

The invention relates to a continuous casting mould for liquid metals, especially for liquid steel, comprising steel charging plates (2) which are surrounded by water reservoirs (1), cassette-type copper plates (3) arranged against the same, end plates (7), if needed, for the thickness and/or the width of the cast billet, and coolant channels (9). The aim of the invention is to take measures to counteract the high temperatures in the meniscus region (13) using appropriate embodiments of the copper plates (3) and/or the steel charging plates (2). To this end, the thickness (10) of the copper plates (3) between the coolant (11) and the hot side (3*a*) of the copper plates varies along the width (2×L) and/or in terms of the height (12).

8 Claims, 4 Drawing Sheets

$0 \leq D_{PI2} < 10$ $20\,mm > D_{Cu1} + D_{PI1} = D_{Cu2} + D_{PI2} = D_{Cu3} + D_{PI3} > 10\,mm$ $L3 = 0,5 - 0,8\ T_F / 2$ $L1 = 0,5 - 0,8\ (L - T_F / 2)$ $L2 = L - (L1 + L3)$

CONTINUOUS CASTING MOLD FOR LIQUID METALS, ESPECIALLY FOR LIQUID STEEL

CROSS-REFERENCE TO RELATED APPLICATION

This application is a 371 of PCT/EP03/03081 filed on Mar. 25, 2003.

BACKGROUND OF THE INVENTION

The invention concerns a continuous casting mold for liquid metals, especially liquid steel, with steel charging plates, which are arranged parallel opposite each other to form the casting cross section and are surrounded by water tanks; with cassette-type copper plates, which rest against the steel charging plates and bound the casting cavity; possibly with end plates, which are inserted at the end faces of the casting cavity for establishing the thickness and/or width of the cast strand and close the casting cavity at the end faces; and with coolant channels that connect an inlet with an outlet in the copper plates at their contact surfaces with the steel charging plates.

The specified continuous casting mold is known from DE 195 81 604 T1. A continuous casting mold of this type represents a so-called cassette mold. The cassette mold has cassette-like copper plates that rest against the steel charging plates and bound the casting cavity. In principle, it has the advantages that fewer water tanks are needed, that shorter changing times for the cassette-like copper plates are necessary, that conveyance costs are lower due to the lower conveyance weight, and that the service life of molds of this type are longer. Despite these advantages, the cassette mold has the disadvantage of a high hot-side temperature in the meniscus region with a sharp temperature drop below it. This results in a high load of the strand shell on the cast strand and thus the danger of surface defects. In addition, an uneven slag film thickness develops prematurely due to the significantly different hot-side temperature in the upper region of the mold.

Furthermore, it must be assumed on the basis of experience that different mold temperatures are also present along the cast width, which can have a negative effect on the service life of the mold and the surface quality of the cast strand.

SUMMARY OF THE INVENTION

The objective of the invention is to propose measures that counteract the high temperatures in the meniscus region of a cassette mold of this type by suitable design of the copper plates and/or the steel charging plates.

In accordance with the invention, this objective is achieved by varying the thickness of the copper plates between the coolant and the hot side of the copper plates over the width and/or over the height. In this way, the hot-side temperature can be evened out over the width of the mold, and the significant temperature drop below the meniscus region can be reduced over the height of the mold.

In one embodiment, the coolant channels run in the copper plate and at least partially in the adjacent steel charging plate. On the one hand, this guarantees equal flow rates in the coolant channels and, on the other hand, the production of the coolant channels in the copper plate and in the steel charging plate is greatly simplified.

The improved heat dissipation in the meniscus region can be still further improved by making the cross section of the coolant channel smaller in the meniscus region than elsewhere in the coolant channel.

In another measure for reducing the hot-side temperature in the meniscus region, the thickness between the coolant channel and the hot-side surface of the copper plate is smaller than it is above and below this region.

Temperature equalization between higher and lower regions within the height of the continuous casting mold is further promoted by limiting the smaller thickness between the coolant channel and the hot-side surface of the copper plate to a certain height section and continuously increasing the thickness to a certain distance in lower sections.

When the coolant channels are suitably incorporated in the steel charging plate, it is provided that the distance of the hot-side surface of the copper plate from the coolant channel is constant in the same height sections.

The arrangement of the coolant channels generally depends on the interior shape of the casting cavity. To this end, it is proposed that in the width section, the distance to the hot-side surface is smaller in the central region than in the peripheral region. This makes it possible to make the temperature of the hot side more uniform.

For this purpose, it is further proposed that grooves in the copper plate which communicate with the coolant channel are formed with groove depths greater than 10 mm and less than 25 mm.

Special molds for casting thin slabs are used in CSP plants. Here it is advantageous that a funnel mold can be used and that the width section with the greatest distance of the coolant channel from the hot-side surface of the copper plate has a length of 50-80% of the width region in the funnel.

In accordance with additional features, an external width region of the funnel cross section is 50-80% of the wide-side length "L" minus half the width of the funnel.

BRIEF DESCRIPTION OF THE DRAWING

Specific embodiments of the invention are illustrated in the drawings and are described in greater detail below.

DETAILED DESCRIPTION OF THE INVENTION

Figure 1:
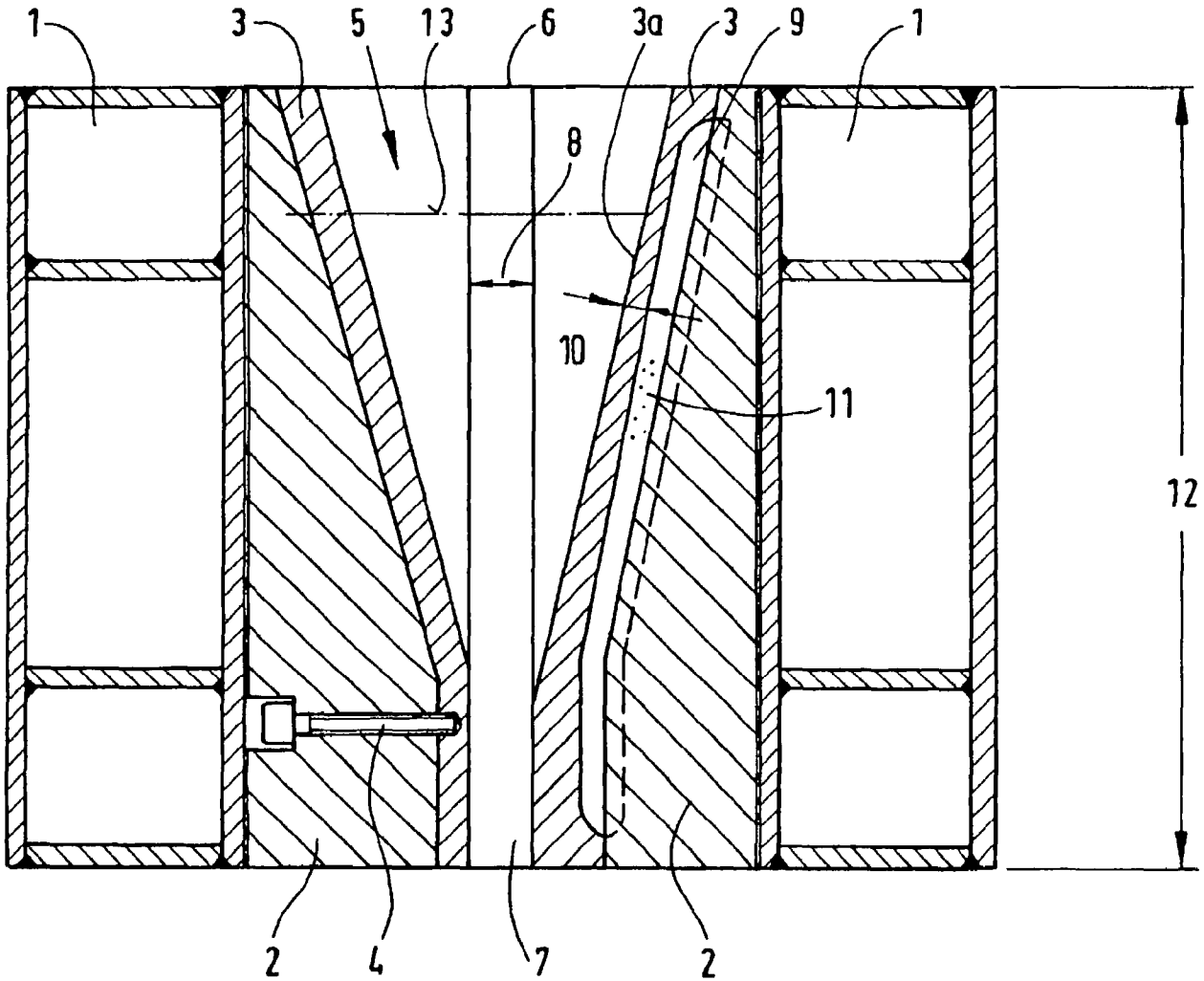
FIG. 1 shows a vertical center cross section through the continuous casting mold.

In the continuous casting mold, liquid metals, especially liquid steel, are cast into cast strands with various formats and with billet, bloom, slab, and thin-slab cross sections. Opposing steel charging plates 2 and copper plates 3 that rest against the steel charging plates 2 are mounted inside a water tank 1, e.g., fastened with screws 4 to the steel charging plates 2, which form a cassette. The copper plates 3 bound the casting cavity 5. End plates 7, so-called narrow-side plates, are arranged between the copper plates 3. The thickness 8 of the end plates 7 forms the thickness of the cast strand, or the end plates 7 determine the width of the cast strand by the distance that separates them.

Coolant channels 9, each of which is provided with an inlet and an outlet, are incorporated in the copper plates 3 at the boundary with the steel charging plates 2.

In contrast to previous mold copper plates 3, the thickness 10 of the copper plates 3 between the coolant 11 and the hot side 3*a* of the copper plates 3 varies over the width 2×L and/or over the height 12 of the mold. In the region of the meniscus 13, the thickness 10 of the copper plate 3 is kept smaller than in the deeper, larger region, so that the heat dissipation in the meniscus region 13 is significantly greater than in the deeper region. This results in the establishment of a lower hot-side temperature in the meniscus region.

As is indicated in FIG. 1 by the broken line, the coolant channels 9 in the copper plate 3 can also run at least partially in the adjacent steel charging plate 2.

In the region of the meniscus 13 (FIG. 2), the copper plate 3 is kept uniformly thick, and the coolant channels 9 are also uniformly deep. Accordingly, a narrower coolant channel 9 is designed normally through an opposing steel charging plate 2 at a height H1 at the meniscus 13 and more narrowly at the height H2 below it, so that the desired higher flow rate of the coolant 11 is produced between the copper plate 3 and the steel charging plate 2 at height H2. The coolant 11 can be conveyed alternatively from top to bottom or from bottom to top. A smaller cross section 14 of the coolant channel 9 is thus obtained at the height H2. In a practical embodiment, the height H1 can be 40-90 mm, and the height H2 can be 80-150 mm.

The coolant channel cross section 14 (FIG. 3) is designed with minimum thickness ($A_{min}$) at height H2. In the lower regions, the coolant channel cross section 14 is continually larger, and the lower region of the thickness ($A_u$) of the copper plate 3 is also designed continually larger.

Figure 2:
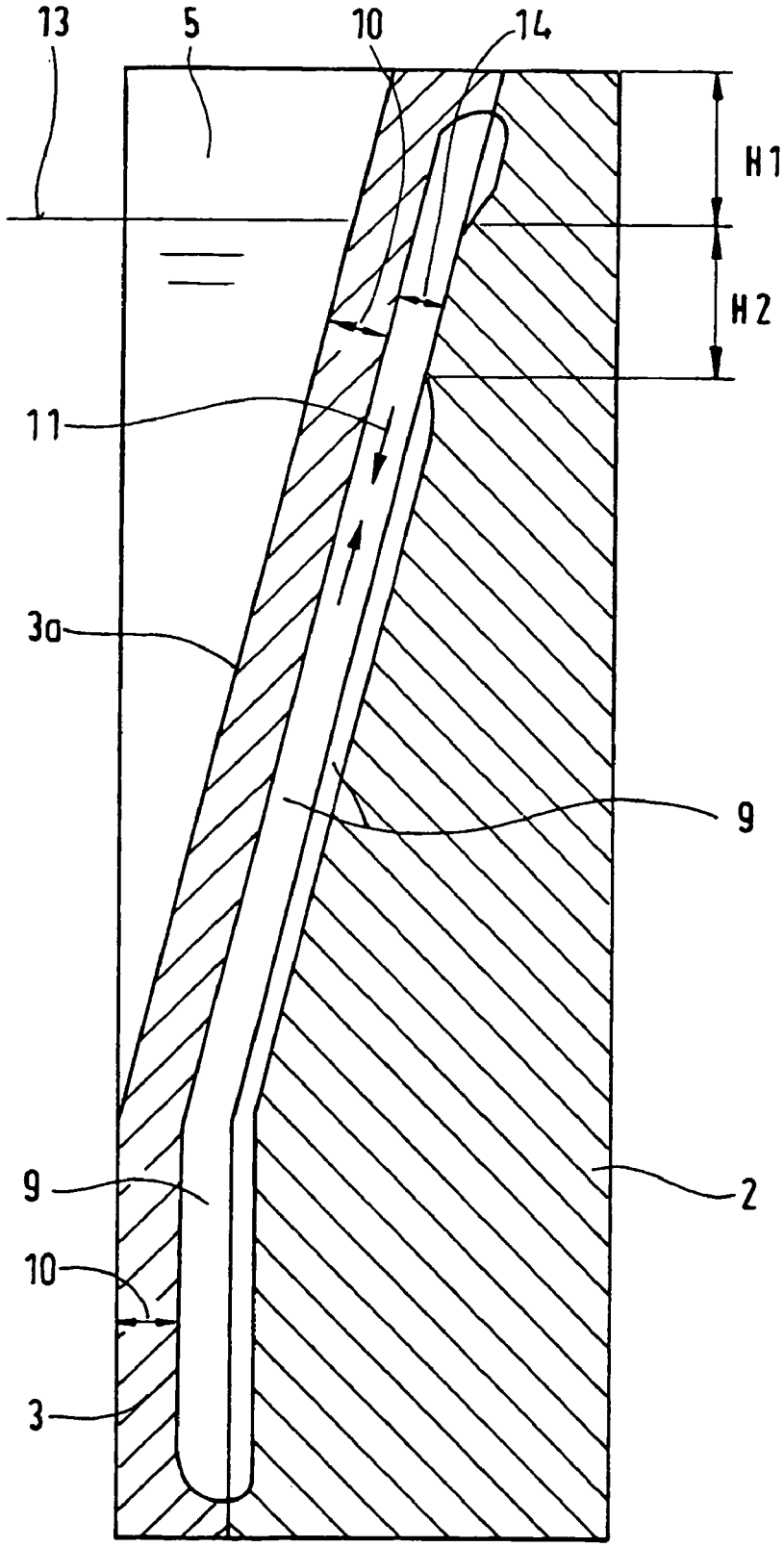
FIG. 2 shows a vertical partial cross section through the copper plate with the steel charging plate.
Figure 3:
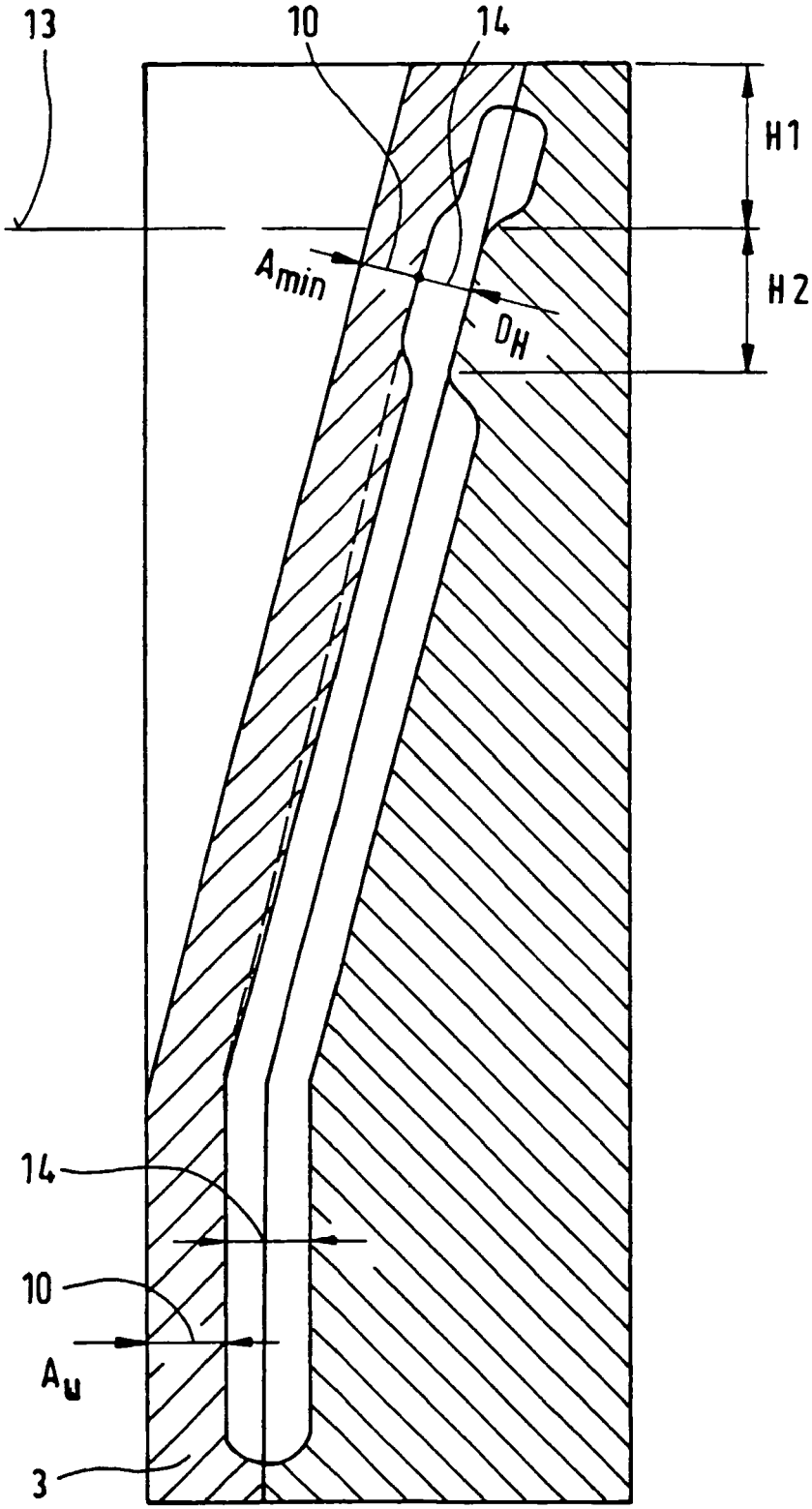
FIG. 3 shows the same cross section as FIG. 2 for an alternative embodiment.

Furthermore, in the meniscus region 13, the thickness 10 of the copper plate 3 between the coolant channel 9 and the hot-side surface 3*a* of the copper plate 3 is the same at the top and the bottom in FIG. 2, but in FIG. 3, this thickness 10 is small at the top and larger at the bottom.

The smaller thickness 10 between the coolant channel 9 and the hot-side surface 3*a* of the copper plate 3 is limited to the height section H2. This smaller thickness 10 between the coolant channel 9 and the hot-side surface 3*a* of the copper plate 3 increases continuously to the distance $A_u$, in the sections below the height section H2.

Figure 4:
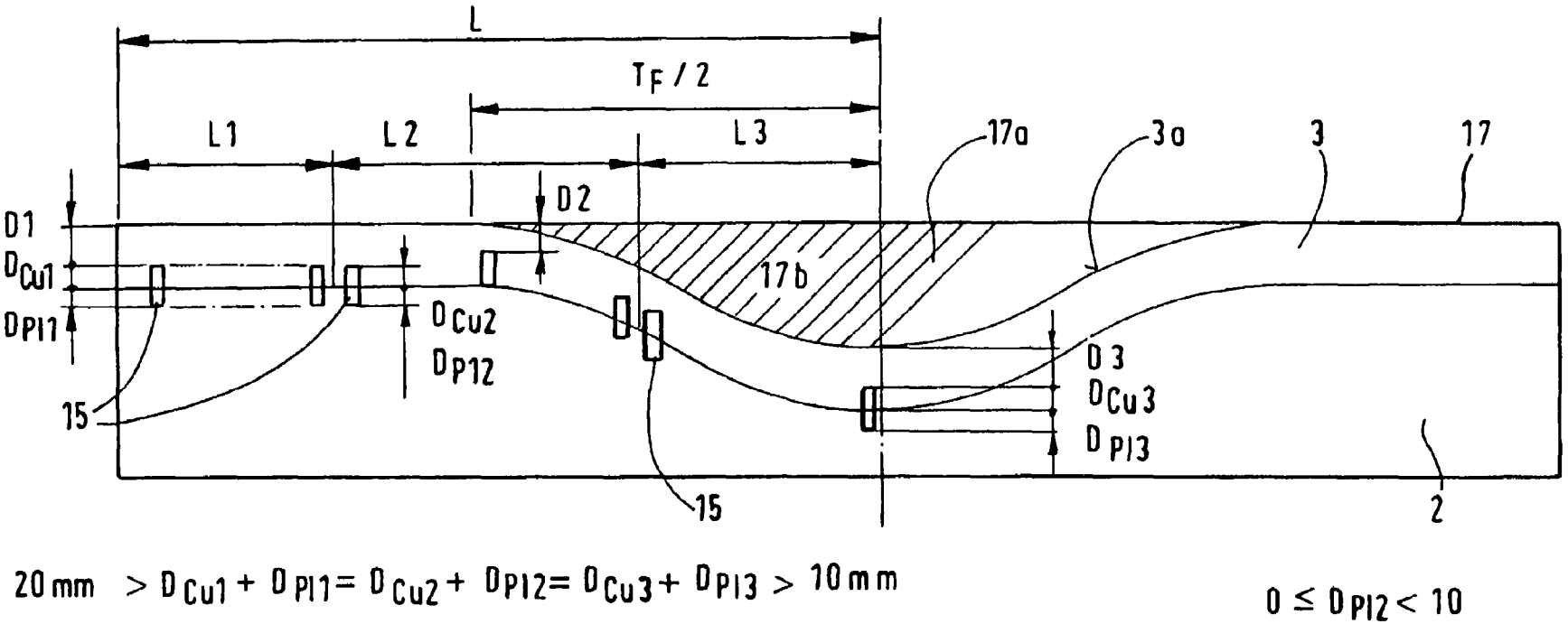
FIG. 4 shows a top view of a wide side of a mold designed as a funnel mold.

As shown in FIG. 4, the copper wall thickness of a funnel mold 17 in front of the coolant and/or the cooling groove geometry (depth, width, diameter, and distance) varies over the mold width 2×L. This additionally evens out the hot-side temperature over the mold width 2×L, and the significant temperature drop below the meniscus region 13 can also be reduced over the height 12 of the mold.

In this regard (FIG. 4), a distance D1, D3 of the hot-side surface 3*a* of the copper plate 3 is held constant in the same width sections L1, L3. In addition, in the same width sections L1, L2, L3, starting from the width sections L1, L3 with the distances D1, D3, a distance D2 in the width section L2 is reduced to a dimension D2 towards the central region. Grooves 15 that communicate with the coolant channel 9 are formed in the copper plate 3 with groove depths greater than 10 mm and less than 25 mm.

When a funnel mold 17 (for CSP plants) is used, the width section L3 with the greater distance D3 of the coolant channel 9 from the hot-side surface 3*a* of the copper plate 3 has a length of 50-80% of the length region L in the funnel 17*a*.

An external width region L1 of the copper plates 3 is 50-80% of the wide-side half-length L minus the funnel half-width L3.

The grooves 15 in the width section L1 with the distance $D_{Cu1}$ and the groove depth $D_{P11}$ are the same as in L2 with $D_{Cu2}+D_{P12}$ and the same as in L3 with $D_{Cu3}+D_{P13}$. The total groove depth is less than 20 mm and greater than 10 mm.

The width sections L are to be dimensioned with L1=0.5-0.8 ($L-T_F/2$), L2=L−(L1+L3), and L3=0.5-0.8 $T_F/2$, where $T_F/2$ is half the funnel width.

LIST OF REFERENCE SYMBOLS

1 water tank
2 steel charging plate
3 copper plate
3*a* hot-side surface
4 screws
5 casting cavity
6 end face
7 end plates
8 thickness of the end plate
9 coolant channel
10 thickness of the copper plate
11 coolant
12 height of the mold
13 meniscus (region)
14 coolant channel cross section
15 grooves
16 groove depth
17 funnel mold
17*a* funnel
L half the mold plate width
L1, L2, L3 width sections
$D_{Cu1}$, $D_{Cu2}$, $D_{Cu3}$ distances in the copper
$D_{P11}$, $D_{P12}$, $D_{P13}$ groove depth
$T_F$ groove cross section

The invention claimed is:

1. Continuous casting mold for liquid metals, especially liquid steel, comprising: steel charging plates, which are arranged parallel opposite each other to form the casting cross section and are surrounded by water tanks; cassette-type copper plates, which rest against the steel charging plates and bound the casting cavity; possibly end plates, which are inserted at the end faces of the casting cavity for establishing the thickness and/or width of the cast strand and close the casting cavity at the end faces; and coolant channels that connect an inlet with an outlet in the copper plates at their contact surfaces with the steel charging plates; wherein the thickness (10) of the copper plates (3) between the coolant (11) and the hot side (3*a*) of the copper plates (3) varies over the width (2×L) and/or over the height (12) of the mold, wherein the coolant channels (9) run in the copper plate (3) and at least partially in the adjacent steel charging plate (2); wherein a cross section (14) of the coolant channel (9) is smaller in a meniscus region (13) than elsewhere in the coolant channel (9).

2. Continuous casting mold in accordance with claim 1, wherein the thickness (10) between the coolant channel (9) and the hot-side surface (3*a*) of the copper plate (3) is smaller in the meniscus region (13) than it is above or below this region.

3. Continuous casting mold in accordance with claim 2, wherein the smaller thickness (10) between the coolant channel (9) and the hot-side surface (3*a*) of the copper plate (3) is limited to the height section (H2), and the smaller thickness increases continuously to a distance ($A_u$) in lower sections.

4. Continuous casting mold in accordance with claim 1, wherein the hot-side surface (3*a*) of the copper plate (3) has a section of a distance (D1; D3) that is constant in the same width sections (L1; L3).

5. Continuous casting mold in accordance with claim 1, wherein in width section (L2), the distance to the hot-side surface (3*a*) is smaller in the central region than in the peripheral region.

6. Continuous casting mold in accordance with claim 1, wherein grooves (15) in the copper plate (3) which communicate with the coolant channel (9) are formed with groove depths (16) greater than 10 mm and less than 20 mm.

7. Continuous casting mold in accordance with claim 1, wherein a funnel mold (17) can be used and the width section (L3) forming a greatest distance (D3) of the coolant channel (9) from the hot-side surface (3*a*) of the copper plate (3) has a length of 50-80% of a length of the width region (L) in the funnel (17*a*).

8. Continuous casting mold in accordance with claim 7, wherein an external width region (L1) of the copper plate (3) is 50-80% of the wide-side half-length (L) minus the funnel half-width (L3).

* * * * *